US012601149B2

(12) United States Patent
Humphrey et al.

(10) Patent No.: US 12,601,149 B2
(45) Date of Patent: Apr. 14, 2026

(54) AUTOMATIC PRESSURE RELEASE

(71) Applicant: Caterpillar Work Tools B.V., 's-Hertogenbosch (NL)

(72) Inventors: James Edward Humphrey, Bourne (GB); Sebastian Jacob, Ilmenau (DE); Tobias Lippa, Schwandorf (DE)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 253 days.

(21) Appl. No.: 18/028,624

(22) PCT Filed: Mar. 25, 2021

(86) PCT No.: PCT/EP2021/057829
§ 371 (c)(1),
(2) Date: Mar. 27, 2023

(87) PCT Pub. No.: WO2022/073651
PCT Pub. Date: Apr. 14, 2022

(65) Prior Publication Data

US 2023/0366177 A1 Nov. 16, 2023

(30) Foreign Application Priority Data

Oct. 6, 2020 (GB) ..... 2015847
Nov. 2, 2020 (GB) ..... 2017335

(51) Int. Cl.
*E02F 9/22* (2006.01)
*E02F 3/36* (2006.01)

(52) U.S. Cl.
CPC ..... *E02F 9/2228* (2013.01); *E02F 3/3609* (2013.01); *E02F 9/2278* (2013.01)

(58) Field of Classification Search
CPC ..... E02F 9/2228; E02F 3/3609; E02F 9/2278
See application file for complete search history.

(56) References Cited

U.S. PATENT DOCUMENTS 6,318,234 B1 11/2001 Mate
6,837,319 B2 1/2005 Dvorak et al.
(Continued)

FOREIGN PATENT DOCUMENTS

EP 1239208 A2 9/2002
EP 2362023 A1 8/2011
(Continued)

OTHER PUBLICATIONS

International Search Report related to Application No. PCT/EP2021/057829; reported on Jul. 12, 2021.
(Continued)

*Primary Examiner* — Navid Z. Mehdizadeh
*Assistant Examiner* — Oliver Tan

(57) ABSTRACT

A controller for hydraulic system of a work machine is provided. The controller is configured to perform a worktool disconnect routine to reduce pressure in a first worktool line and a second worktool line of the hydraulic system. The hydraulic system comprises a spool valve, a first worktool port connected to the spool valve by the first worktool line, a second worktool port connected to the spool valve by the second worktool line, a high pressure flow source of hydraulic fluid connected to the spool valve by a high pressure line and a low pressure tank line connected to the spool valve, the low pressure tank line at a lower pressure than a pressure of the high pressure line. When performing the worktool disconnect routine the controller is configured to: check that a power source of the work machine is operating, instruct the high pressure flow source of hydraulic fluid to provide no flow of hydraulic fluid in the high pressure line to the spool valve, instruct the spool valve to move to a first position wherein the first worktool port is connected to the low pressure tank line and the second worktool port is connected to the high pressure flow source in order to reduce a pressure
(Continued)

in the first worktool line, and instruct the spool valve to move to a second position wherein the second worktool port is connected to the low pressure tank line and the first worktool port is connected to the high pressure flow source in order to reduce a pressure in the second worktool line.

19 Claims, 6 Drawing Sheets

(56) References Cited

U.S. PATENT DOCUMENTS

| | | | | |
|---|---|---|---|---|
| 8,001,751 | B2 | 8/2011 | Ehrhart et al. | |
| 10,458,445 | B2 | 10/2019 | Bauer | |
| 10,550,541 | B1 * | 2/2020 | Diaz | E02F 3/3627 |
| 2002/0157528 | A1 * | 10/2002 | Yoshino | F15B 21/14 91/454 |
| 2004/0016586 | A1 * | 1/2004 | Dvorak | E02F 9/2275 180/272 |
| 2007/0261403 | A1 | 11/2007 | Eppler | |
| 2013/0047599 | A1 * | 2/2013 | Opdenbosch | E02F 9/2292 137/516 |
| 2014/0060034 | A1 * | 3/2014 | Du | F04B 35/04 60/459 |
| 2014/0212846 | A1 | 7/2014 | Miller et al. | |
| 2015/0247451 | A1 * | 9/2015 | Gratton | F02B 47/08 60/273 |
| 2015/0330474 | A1 * | 11/2015 | Rubitzko | F16F 9/54 137/625.35 |
| 2016/0090997 | A1 * | 3/2016 | Johnson | E02F 9/2267 137/599.11 |
| 2016/0348799 | A1 | 12/2016 | Preston et al. | |
| 2019/0194004 | A1 | 6/2019 | Balley | |
| 2019/0330819 | A1 | 10/2019 | Sato et al. | |

FOREIGN PATENT DOCUMENTS

| | | | |
|---|---|---|---|
| EP | 3064653 | A1 | 9/2016 |
| JP | S63101061 | A | 5/1988 |
| JP | 2003004004 | A | 1/2003 |
| JP | 2017187144 | A | 10/2017 |

OTHER PUBLICATIONS

Great Britain Search Report related to Application No. 2017335.7; reported on Mar. 18, 2021.

* cited by examiner

AUTOMATIC PRESSURE RELEASE

CROSS-REFERENCE TO RELATED APPLICATION

This Application is a 35 USC § 371 US National Stage filing of International Application No. PCT/EP2021/057829 filed on Mar. 25, 2021 which claims priority under the Paris Convention to Great Britain Patent Application No. 2017335.7 filed on Nov. 2, 2020 and to Great Britain Patent Application No. 2013847.3 filed on Oct. 6, 2020.

FIELD OF THE DISCLOSURE

The present invention relates to hydraulic systems. In particular the present disclosure relates to hydraulic systems for worktools.

BACKGROUND

Work machines may include one or more interchangeable hydraulically-driven implements (worktools). By altering the worktool attached to the work machine, the function of the work machine can be altered. For example, a worktool for a work machine may include an auger, a bucket, a fork, a hammer, a mulcher, a broom, a demolition tool, a tiltrotator or the like.

In order to provide the interchangeable functionality of a worktool, it must be possible to disconnect each worktool from a work machine and install another worktool. Part of the process of disconnecting the worktool includes disconnecting the hydraulic lines of the worktool from the hydraulic lines of the work machine which supply hydraulic fluid to the worktool.

It is known that opening a closed hydraulic system can be difficult, and may be undesirable when the system is under high pressure. As such, attempting to disconnect the hydraulic lines of a worktool from the hydraulic lines of a work machine when under high pressure can be difficult. Furthermore, attempting to connect the hydraulic lines of the worktool to be connected to the hydraulic lines of the work machine may also be difficult when the hydraulic lines of the work machine are under high pressure.

SUMMARY

According to a first aspect of the disclosure a controller for hydraulic system of a work machine is provided. The controller is configured to perform a worktool disconnect routine to reduce pressure in a first worktool line and a second worktool line of the hydraulic system. The hydraulic system comprises a spool valve, a first worktool port connected to the spool valve by the first worktool line, a second worktool port connected to the spool valve by the second worktool line, a high pressure flow source of hydraulic fluid connected to the spool valve by a high pressure line, and a low pressure tank line connected to the spool valve, the low pressure tank line at a lower pressure than a pressure of the high pressure line. When performing the worktool disconnect routine the controller is configured to:

- check that a power source of the work machine is operating;
- instruct the high pressure flow source of hydraulic fluid to provide no flow of hydraulic fluid in the high pressure line to the spool valve;
- instruct the spool valve to move to a first position wherein the first worktool port is connected to the low pressure tank line and the second worktool port is connected to the high pressure flow source in order to reduce a pressure in the first worktool line; and
- instruct the spool valve to move to a second position wherein the second worktool port is connected to the low pressure tank line and the first worktool port is connected to the high pressure flow source in order to reduce a pressure in the second worktool line.

Accordingly, the controller of the first aspect is able to automatically reduce the pressure in first and second worktool lines of a work machine to enable a worktool to be disconnected from a work machine. The controller is configured to perform a worktool disconnect routine using the hydraulic system which, in normal use, is provided to control the supply of hydraulic fluid to the worktool. As such, the controller of the present disclosure provides additional functionality to a hydraulic system (the worktool disconnect routine) to allow a worktool to be more easily disconnected. Accordingly, the worktool disconnect routine may provide a pressure reducing functionality for the purposes of disconnecting a worktool from a hydraulic system of a work machine without any additional valves or auxiliary components which may not be used during a normal use of the hydraulic system/worktool.

According to this disclosure, the worktool disconnect routine performed by the controller is understood to be a process which reduces pressure in the first and second worktool lines of the hydraulic system. As such, the skilled person understands that the worktool disconnect routine may be performed as part of a process for disconnecting a worktool, but is not limited to only such processes. The skilled person understands that the worktool disconnect routine may be used for other processes, for example connecting a new worktool to the hydraulic system of the work machine. That is to say, the worktool disconnect routine may be performed to reduce the pressure in the first and second worktool lines prior to the connecting the first and second lines to hydraulic lines of a new worktool. By reducing the pressure in the first and second hydraulic lines, it may be easier to connect the hydraulic lines together, thereby improving the lifetime of the connectors for the hydraulic lines.

The controller of the first aspect allows the pressure to be reduced in the first and second worktool lines in a controlled manner without any further requirement for operator intervention. The movement of the spool valve can be controlled precisely by the controller. This in turn ensures, for example, that any worktool actuators connected to the first and second worktool lines do not excessively move during the worktool disconnect operation. Thus, the controller of the first aspect provides a way of reducing pressure in the hydraulic system with improved safety.

In some embodiments, the worktool disconnect routine performed by the controller may be initiated by an operator of the work machine. For example, an operator of the work machine may initiate the worktool disconnect routine using a button press, or through a computer based user interface. In some embodiments, the worktool disconnect routine may be initiated by a user triggering a switch in communication with a coupling mechanism for the worktool.

Smart couplers, quick couplers and the like provide for a work machine operator coupling the work machine with a worktool or decoupling the work machine from the worktool without having to leave the machine's cab, operator seat and/or the like. Instead, the machine operator, which may be a processor for an automated machine, initiates a coupling/decoupling operation from inside the machine. Smart couplers, quick couplers and the like generally include safety mechanisms to prevent inadvertent activation of the coupler and/or activation of the coupler when the worktool and/or the work machine are in operating modes where coupling/de-coupling is dangerous. As such, in some embodiments the controller may be configured to receive a signal from a smart coupling mechanism for the worktool when a disconnect/connect routine of the smart coupling mechanism is initiated and may process the pressure reduction prior to the rest of the coupling/de-coupling routine. Additionally, in some embodiments, the pressure reduction may only be activated by the controller if the safety mechanisms of the smart coupling mechanism determines that the worktool/work machine are in operating modes where it is safe to proceed with the coupling/de-coupling routine. In some embodiments, the operation of the smart coupling mechanism may include processing that the reduction in pressure has been initiated and a delay time in the coupling/de-coupling procedure is provided to allow for pressure reduction in the hydraulic system. In some embodiments, a sensor in the hydraulic system may be used to detect the reduction in pressure in the hydraulic system.

According to a second aspect of the disclosure, a hydraulic system for a work machine having a power source is provided. The hydraulic system comprises:

- a spool valve;
- a first worktool line and a second worktool line;
- a first worktool port connected to the spool valve by the first worktool line;
- a second worktool port connected to the spool valve by the second worktool line;
- a high pressure flow source of hydraulic fluid connected to the spool valve by a high pressure line;
- a low pressure tank line connected to the spool valve, the low pressure tank line at a lower pressure than a pressure of the high pressure line; and
- a controller configured to perform a worktool disconnect routine to reduce pressure in a first worktool line and a second worktool line of the hydraulic system. The controller is configured to:
- check that the power source of the work machine is operating;
- instruct the high pressure flow source of hydraulic fluid to provide no flow of hydraulic fluid in the high pressure line to the spool valve;
- instruct the spool valve to move to a first position wherein the first worktool port is connected to the low pressure tank line and the second worktool port is connected to the high pressure flow source in order to reduce a pressure in the first worktool line; and
- instruct the spool valve to move to a second position wherein the second worktool port is connected to the low pressure tank line and the first worktool port is connected to the high pressure flow source in order to reduce a pressure in the second worktool line.

As such, the hydraulic machine of the second aspect is configured to perform the worktool disconnect routine in addition to the normal operations of a work machine.

According to a third aspect of the disclosure, a work machine comprising a hydraulic system according to the second aspect of the disclosure is provided, wherein the work machine is one of a tractor, an excavator, a wheel loader or a compactor.

BRIEF DESCRIPTION OF THE FIGURES

Embodiments of the disclosure will now be described, by way of example only, with reference to the accompanying drawings in which.

DETAILED DESCRIPTION

Figure 1:
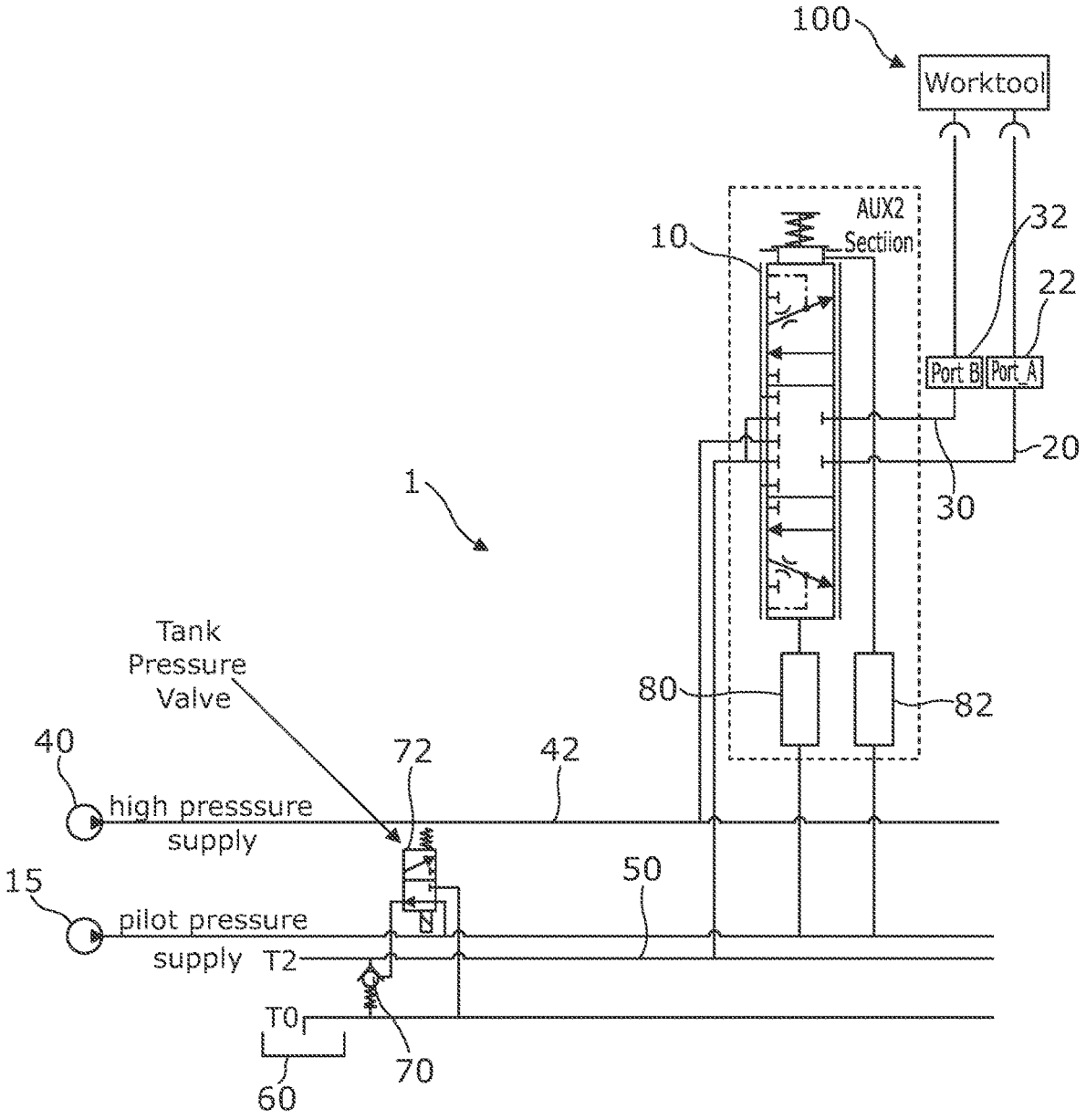
FIG. 1 shows a schematic diagram of a hydraulic system of a work machine according to an embodiment of the disclosure.

According to an embodiment of the disclosure, a hydraulic system 1 for a work machine is provided. The hydraulic system 1 comprises: a spool valve 10, a first worktool line 20, a second worktool line 30, a first worktool port 22, a second worktool port 32, a high pressure flow source of hydraulic fluid 40, a low pressure tank line 50 and a controller (not shown). A schematic diagram of the hydraulic system 1 is shown in FIG. 1.

The hydraulic system 1 is provided on a work machine (not shown). The hydraulic system 1 is provided to supply hydraulic fluid to a worktool 100 in order to drive the worktool 100. The hydraulic lines of the worktool 100 are configured to be connected to the first and second worktool ports 22, 32. The first and second worktool ports 22, 32 may be configured to attach to the hydraulic lines of the worktool 100 using a suitable connector.

The first and second hydraulic ports 22, 32 are connected to first and second worktool lines 20, 30 respectively. The first and second worktool lines 20, 30 are connected between the spool valve 10 and the first and second worktool ports 22, 32 to supply hydraulic fluid. In this disclosure, references to connections, or parts of the hydraulic system being connected, are understood to mean fluidly connected for the purpose of transporting hydraulic fluid. In normal operation of the work machine, the first and second worktool lines 20, 30 supply hydraulic fluid to the worktool 100 via the first and second worktool ports 22, 32 in order to operate the worktool 100. For example, hydraulic fluid may be supplied to a cylinder of a worktool 100 in order to actuate the cylinder. When actuating a cylinder, hydraulic fluid may flow from the hydraulic system 1 to the worktool 100 via one of the first and second hydraulic lines 20, 30 and return to the hydraulic system 1 from the worktool 100 via the other of the first and second hydraulic lines 20, 30.

The high pressure flow source of hydraulic fluid 40 provides a source of pressurised hydraulic fluid for the operation of the worktool 100. In the embodiment of FIG. 1, the high pressure flow source of hydraulic fluid 40 is configured to provide hydraulic fluid for one worktool 100. In other embodiments, the high pressure flow source of hydraulic fluid 40 may be configured to provide a source of pressurised hydraulic fluid to a plurality of worktools 100 and/or other hydraulically actuated components of the work machine.

In the embodiment of FIG. 1, the high pressure flow source of hydraulic fluid 40 is configurable to provide no flow of hydraulic fluid to the spool valve 10 while the power source of the work machine is still in operation. In the embodiment of FIG. 1, the high pressure flow source of hydraulic fluid 40 may be provided by a variable displacement pump (not shown). The variable displacement pump may be destroked in order to provide substantially zero flow of hydraulic fluid. As shown in FIG. 1, the high pressure flow source of hydraulic fluid 40 is connected to the spool valve 10 by a high pressure line 42. In the embodiment of FIG. 1 the high pressure flow source of hydraulic fluid 40 may be configured to provide hydraulic fluid at a pressure suitable for operation of the desired worktool 100.

For example, in some embodiments, the high pressure flow source of hydraulic fluid 40 may supply hydraulic fluid at a pressure of at least 100 bar, or at least 500 bar, although in other embodiments other pressures may be provided.

In the embodiment of FIG. 1, the low pressure tank line 50 is a hydraulic line which is maintained at a pressure which is lower than the pressure in the high pressure line connected to the high pressure flow source of hydraulic fluid 50. In the embodiment of FIG. 1, the low pressure tank line 50 is at a pressure of at least 1 bar. In some embodiments, the low pressure tank line may be at a pressure of no greater than 10 bar. In some embodiments, the low pressure tank line may be at a pressure of no greater than 15 bar. In the embodiment of FIG. 1, the low pressure tank line may be at a pressure of about 5 bar. In normal operation, the low pressure tank line 50 may be configured to provide a return line for hydraulic fluid as part of the operation of the worktool 100.

In some embodiments, for example as shown in FIG. 1, the low pressure tank line 50 may be further connected to a hydraulic reservoir 60 via a reservoir pressure valve 70 (tank pressure valve). The hydraulic reservoir 60 comprises hydraulic fluid which is maintained at a lower pressure than the low pressure tank line 50. For example, in some embodiments, the hydraulic reservoir 60 may be held at substantially atmospheric pressure.

The reservoir pressure valve 70 may be provided between the low pressure tank line 50 and the hydraulic reservoir. The reservoir pressure valve 70 may be configured to control the flow (i.e. block or allow flow) of hydraulic fluid from the low pressure tank line 50 to the hydraulic reservoir by operation of the reservoir pressure valve 70. When the reservoir pressure valve is operated to open the reservoir pressure valve, the pressure of the hydraulic fluid in the low pressure tank line 50 may be reduced to about the same pressure as the pressure in the hydraulic reservoir 60.

In order to control the flow of hydraulic fluid from the hydraulic system 1 to the worktool 100, a spool valve 10 is provided. The spool vale 10 is connected to the first and second hydraulic lines 20, 30, and to the high pressure flow source of hydraulic fluid 40 and the low pressure tank line 50. The spool valve 10 is configured to connect the first worktool line 20 to one of the high pressure flow source of hydraulic fluid 40 and the low pressure tank line 50, wherein the second worktool line 30 is connected to the other of the high pressure flow source of hydraulic fluid 40 and the low pressure tank line 50. As such, the spool valve 10 can be controlled to be in one of three positions: a blocking position, a first position, or a second position.

Figure 2:
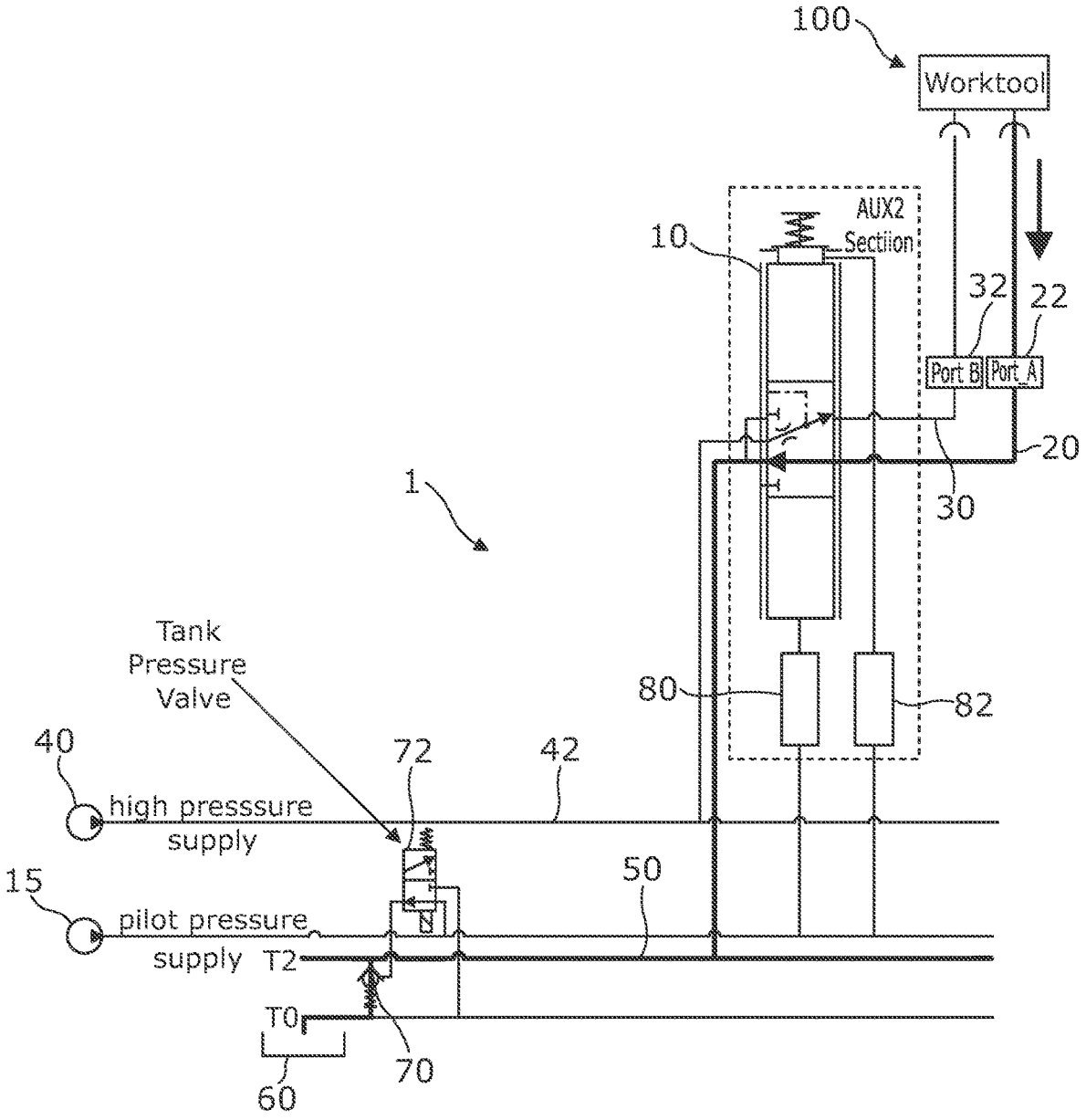
FIG. 2 shows a schematic diagram of a hydraulic system of FIG. 1 where the spool valve is in the first position.

In the diagram of FIG. 1, the spool valve is in the blocking position. When the spool valve is in the blocking position, the high pressure flow source of hydraulic fluid 40 and the low pressure tank line 50 are not fluidly connected to the first and second worktool lines 20, 30. As such, when the spool valve 10 is in the blocking position it is not possible for hydraulic fluid to flow from the high pressure flow source of hydraulic fluid 40 to the worktool 100. When the spool valve is in the first position, the first worktool port 22 is connected to the low pressure tank line 50 via the first worktool line 20. In the second position, the second worktool port 32 is connected to the high pressure flow source 40 via the second worktool line 30. A diagram of the spool valve in the first position is shown in FIG. 2.

When the spool valve 10 is in the second position, the second worktool port 32 is connected to the low pressure tank line 50 via the second worktool line 30. In the second position, the first worktool port 22 is connected to the high pressure flow source 40 via the first worktool line 20.

As such, in normal use (when a worktool 100 is connected to the hydraulic system 1) the spool valve 10 may be configured to control the flow of hydraulic fluid to the worktool 100 in order to operate an actuator of the worktool 100. The spool valve 10 may be controlled to move between the blocking position, the first position, and the second position using a controller. In the embodiment of FIG. 1, the spool valve 10 is a pilot-operated spool valve. A pilot pressure supply 15 is used to move the spool valve 10 between the blocking position, the first position, and the second position. The pilot pressure supply to the spool valve 10 is controlled by first and second pressure reducing valves 80, 82. The first and second pressure reducing valves 80, 82 are electrically controlled valves configured to control the pressure on either side of the spool valve 10. As such, a controller can be used to control the position of the spool valve 10. While in the embodiment of FIG. 1 a pilot pressure supply is used as an interface between the controller and the spool valve 10, in other embodiments other types of valve may be used where the spool valve position is directly controlled by electrical actuators (e.g. solenoids).

In the embodiment of FIG. 1, the reservoir pressure valve 70 may also be a pilot operated valve. The reservoir pressure valve 70 may be controlled by a pilot pressure. The pilot pressure supplied to reservoir pressure valve 72 may in turn be controlled by tank pressure valve 72. Tank pressure valve 72 may be a further spool valve which controls a position (open or closed) of the reservoir pressure valve 70. As shown in FIG. 1, tank pressure valve 72 is a three way, 2 position spool valve. The pilot pressure control for reservoir pressure valve 70 may be connected to either the pilot pressure supply or the hydraulic reservoir 60. The controller may be configured to control the position of the tank pressure valve 72. As such, the reservoir pressure valve 70 may also be controlled by the controller via the pilot pressure supply. As such, it will be appreciated that in order to control the valves of the hydraulic system 1 of the embodiment with a controller, a source of power for the pilot pressure supply is provided. The pilot pressure supply may be generated by the work machine, for example from the same pressure source as the source of high pressure flow 40 for the high pressure line 42.

The processor (not shown) is configured to control the flow of hydraulic fluid to the worktool 100 in order to control the operation of the worktool 100. In normal use of the work machine, the controller (processor) may control the spool valve 10 in order to affect the flow and return of hydraulic fluid through the first and second worktool ports 22, 32 in order to control e.g. a hydraulic actuator of the worktool 100. As such, the controller may issue an instruction to the spool valve 10 to cause a flow of hydraulic fluid in response to a command from an operator of the work machine to move the position of the hydraulic actuator of the worktool 100.

According to embodiments of the disclosure, the controller is also configured to perform a worktool disconnect routine. The worktool disconnect routine may be performed when a worktool 100 is connected to the hydraulic system 1, although it may also be performed at other times. Performing the worktool disconnect routine causes the pressure in the first and second worktool lines 20, 30 (and thus the pressure at the first and second worktool ports 22, 32) to be reduced. Reducing the pressure in the first and second worktool lines allows the worktool hydraulic lines to be more easily disconnected from the work machine.

The pressure reducing functionality of the worktool disconnect routine may be used as part of a process of connecting a new worktool to the hydraulic system 1 of the work machine. Prior to connecting the hydraulic lines of the new worktool to the first and second worktool lines 20, 30, the worktool disconnect routine may be performed to reduce the pressure in the first and second worktool lines 20, 30. By reducing the pressure in the worktool lines, it may be easier to make a connection between the hydraulic lines. For example, in some embodiments, first and second worktool ports 22, 32 may be easier to connect to the hydraulic lines of the worktool following performance of the worktool disconnect routine.

The worktool disconnect routine may be initiated by an operator of the work machine. For example, an operator of the work machine may initiate the worktool disconnect routine using a button press or through a computer based user interface. In some embodiments, the worktool disconnect routine may be initiated by a user triggering a switch integrated into a coupling mechanism for the worktool 100. As such, the work machine may include a coupling mechanism for the worktool 100 comprising a switch configured to initiate the controller to perform a worktool disconnect routine upon activation.

Prior to commencement of the worktool disconnect routine, the work machine and the worktool is understood to not be in active use. As such, it is understood that the worktool is essentially stationary, and as such the spool valve 10 is in the blocking position.

As part of an initial step of the worktool disconnect routine, the controller is configured to check that a power source of the work machine is operating. The worktool disconnect routine involves the operation of the spool valve 10 for which a supply of power is used. If the power source of the work machine is not operating, the controller does not allow the worktool disconnect routine to proceed. In some embodiments, the power source of the work machine for the hydraulic system may be an internal combustion engine, a battery/motor (electrical power) or a hybrid power source (internal combustion engine and motor). The power source of the work machine may be used to provide power for controlling the spool valve and also to provide power for the operation of the high pressure supply of hydraulic fluid 40. In some embodiments, the hydraulic system 1 may have a dedicated power source, or the hydraulic system 1 may share the power source of the work machine with other components of the work machine.

As part of the initial step of the worktool disconnect routine, a check may be performed that the spool valve 10 is in the blocking position and, in an event that the spool valve 10 is not in the blocking position, subsequent steps of the worktool disconnect routine may be prevented until such time as the spool valve 10 is in the blocking position.

As part of the worktool disconnect routine, the controller is configured to instruct the high pressure flow source of hydraulic fluid 40 to provide no flow of hydraulic fluid to the spool valve 10. In the embodiment of FIG. 1, where the high pressure flow source of hydraulic fluid 40 is a variable displacement pump, the controller destrokes the variable displacement pump to provide no flow of hydraulic fluid to the spool valve 10.

Next, the controller instructs the spool valve to move to the first position. By moving the spool valve to the first position, the first worktool port 22 is connected to the low pressure tank line 50 such that the pressure in the first worktool line 20 is reduced. In some embodiments, the spool valve 10 moves to the first position to reduce the pressure in the first worktool line 20 to the pressure in the low pressure tank line 50. In some embodiments, the controller is configured to instruct the spool valve 10 to move to the first position for a time period of no greater than 500 ms. Following the move to the first position, the spool valve 10 may return to the blocking position. By only moving to the first position fora limited period of time (no greater than 500 ms), sufficient time is provided to reduce the pressure in the first worktool line 20 without providing time for any significant flow of hydraulic fluid. Hydraulic fluid does not flow significantly while the spool valve 10 is in the first position because the high pressure flow source of hydraulic fluid 40 is instructed to provide no flow. Also, in the embodiment of FIG. 1, the spool valve 10 is only in the first position for a limited time. Thus, a worktool actuator connected to the hydraulic system 1 does not substantially move as part of the worktool disconnect routine.

FIG. 2 shows a schematic diagram of the hydraulic lines being reduced in pressure (highlighted) when the spool valve 10 is in the first position.

Next, the controller instructs the spool valve 10 to move to the second position wherein the second worktool port 32 is connected to the low pressure tank line 50 and the first worktool port 22 is connected to the high pressure flow source in order to reduce a pressure in the second worktool line 30. In some embodiments, the controller is configured to instruct the spool valve to move to the second position for a time period of no greater than 500 ms. Following the move to the second position, the spool valve 10 may return to the blocking position. By only moving to the second position for a limited period of time (no greater than 500 ms), sufficient time is provided to reduce the pressure in the second worktool line 20 without providing time for any significant flow of hydraulic fluid. Hydraulic fluid does not flow significantly while the spool valve 10 is in the second position because the high pressure flow source of hydraulic fluid 40 is instructed to provide no flow. Also, in the embodiment of FIG. 1, the spool valve 10 is only in the second position for a limited time. Thus, the worktool actuator connected to the hydraulic system 1 does not substantially move as part of the worktool disconnect routine.

In some embodiments, the first and/or second positions of the spool valve 10 may be set by the controller based on a desired cross-sectional area. That is to say, the controller may control the degree to which the spool valve opens when moving to the first and/or second positions. In some embodiments, the first and/or second positions for the worktool disconnect routine may involve the spool valve being only partially open (i.e. not fully open). The desired cross-sectional area of the opening of the spool valve in the first and/or second positions will depend on the size of the spool valve 10. The desired cross sectional area may also depend on the time the spool valve 10 is to remain in the first and/or second positions. The desired cross-sectional area may also depend on the degree of pressure reduction to be performed by the worktool disconnect routine. For example, some embodiments, the desired cross sectional area of the spool valve opening in the first and/or second positions may be no greater than 90% of the maximum opening cross-sectional area of the spool valve 10. In some embodiments, the desired cross sectional area of the spool valve opening in the first and/or second positions may be no greater than: 70%, 50%, 40%, 30%, 20%, 10%, or 5% of the maximum opening. In some embodiments, the first and second positions of the spool valve may have different desired opening cross-sectional areas.

Figure 3:
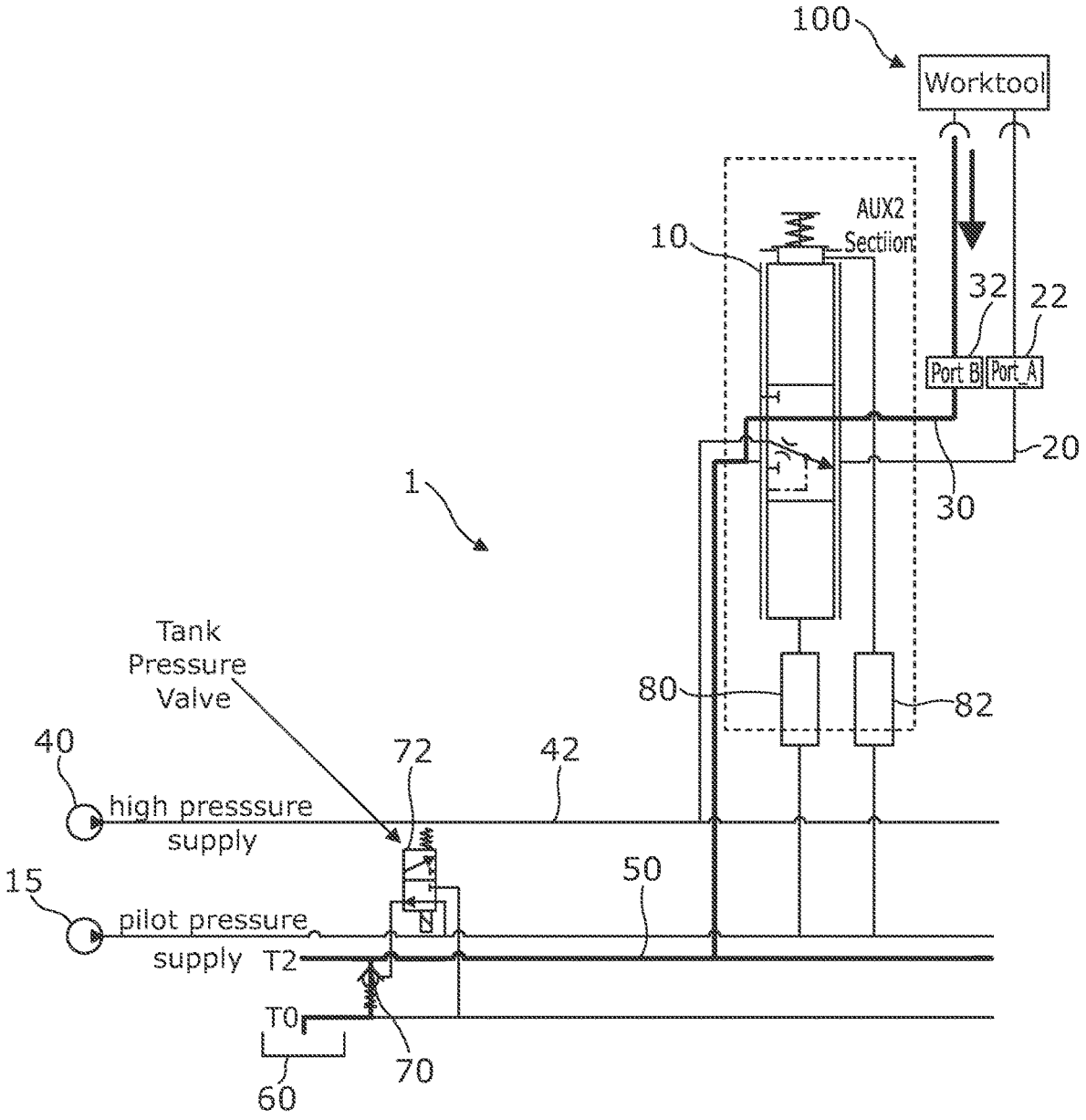
FIG. 3 shows a schematic diagram of a hydraulic system of FIG. 1 where the spool valve is in the second position.

FIG. 3 shows a schematic diagram of the hydraulic lines being reduced in pressure (highlighted) when the spool valve 10 is in the second position.

It will be appreciated that in some embodiments, the controller may instruct the spool valve to move to the first position followed by the second position, whereas in other embodiments, the controller may instruct the spool valve 10 to move to the second position followed by the first position.

In some embodiments, for example in the embodiment of FIG. 1, the controller may also operate the reservoir pressure valve 70 to connect the low pressure tank line to the hydraulic reservoir when the spool valve is in the first position or the second position as part of the worktool disconnect routine. Thus, when the controller moves the spool valve 10 to the first and second positions as part of the worktool disconnect routine, the pressure of the low pressure tank line is further reduced (e.g. to substantially atmospheric pressure). As such, the pressure in the first and second worktool lines 20, 30 may be further reduced to allow for easier disconnection of the hydraulic lines of the worktool 100.

As such, by providing a controller which performs a worktool disconnect routine, a method may be provided by which trapped pressure in the first and second worktool lines 20, 30 is automatically reduced. The controller provides a controlled process for reducing the pressure which does not require operator involvement. As such, the process may be controlled to reduce pressure in the first and second lines which does not result in substantial, unnecessary movement of the worktool actuator. The worktool disconnect routine can be integrated into a work machine without the use of additional valves and external lines for releasing pressure in the first and second worktool lines 20,30.

Figure 4:
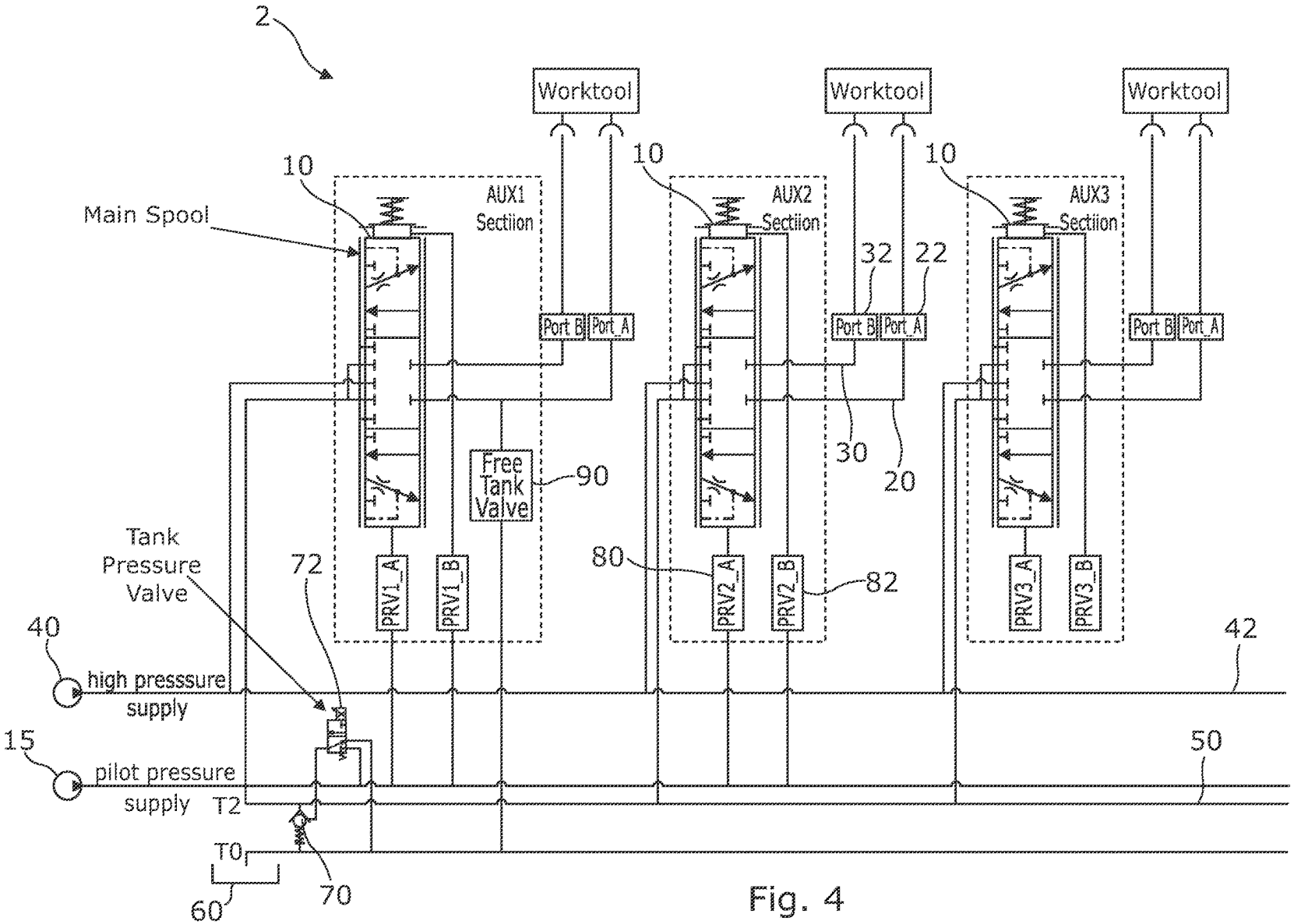
FIG. 4 shows a schematic diagram of a hydraulic system of a work machine according to a further embodiment of the disclosure.

According to a further embodiment of the disclosure, a hydraulic system 2 is provided. A schematic diagram of the hydraulic system 2 is shown in FIG. 4. It will be appreciated that the hydraulic system 2 of FIG. 4 has similarities to the hydraulic system 1 of FIG. 1. Like reference numerals are used to indicate similar parts. The hydraulic system 2 of FIG. 4 comprises a plurality of spool valves 10. Each spool valve is of a similar construction to the spool valve 10 of FIG. 1. Each spool valve 10 controls the flow of hydraulic fluid to a pair of worktool ports 22, 32. Each spool valve 10 is connected to the high pressure flow source of hydraulic fluid 40 via high pressure line 42. Each spool valve 10 is also connected to the low pressure tank line 40.

The controller (not shown) may be configured to perform the worktool disconnect routine for each of the plurality of spool valves 10. The controller may perform the worktool disconnect routine as described above for each spool valve at the same time, or sequentially. Thus, the controller may be provided to reduce the pressure in number of worktool lines to aid the disconnection of one or more worktools. The controller may specify that the worktool disconnect routine is to be performed on only some, or all of the worktool lines.

In the embodiment of FIG. 4, a tank valve 90 is also provided for one of the spool valves 10. The tank valve 90 is connected between the first worktool line 20 and the hydraulic reservoir 60. Such a tank valve 90 may be provided in some hydraulic systems, but not in others (e.g. FIG. 1). As such, the tank valve 90 controls a connection between the first worktool line 20 and the hydraulic reservoir 60. Effectively, the tank valve 90 is connected between the reservoir pressure valve 70 and the first worktool line 20. The tank valve 90 is configured to be normally closed during normal operation. During the worktool disconnect routine, the tank valve 90 may be controlled by the controller to open in order to connect the first worktool line 20 to the hydraulic reservoir. Where a tank valve 90 is provided, the controller may operate the tank valve to connect the first worktool line to the hydraulic reservoir when the spool valve 10 is in the first position.

Figure 5:
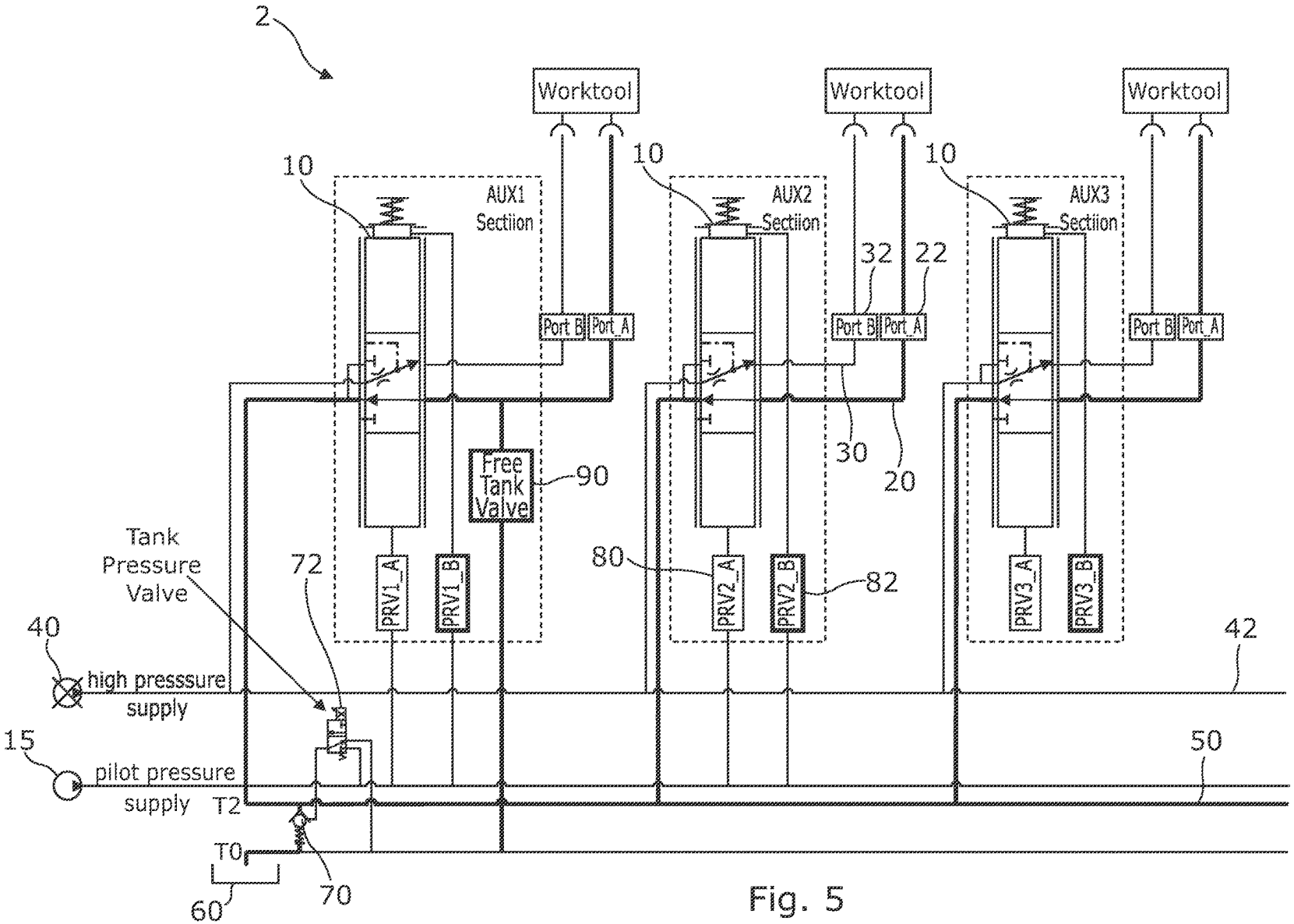
FIG. 5 shows a schematic diagram of a hydraulic system of FIG. 4 where each of the spool valves are in the first position.

FIG. 5 shows a schematic diagram of the hydraulic lines being reduced in pressure (highlighted) when the spool valves 10 are in the first position. In the diagram of FIG. 5, the tank valve 90 is opened at the same time as the spool valve 10 is in the first position.

Figure 6:
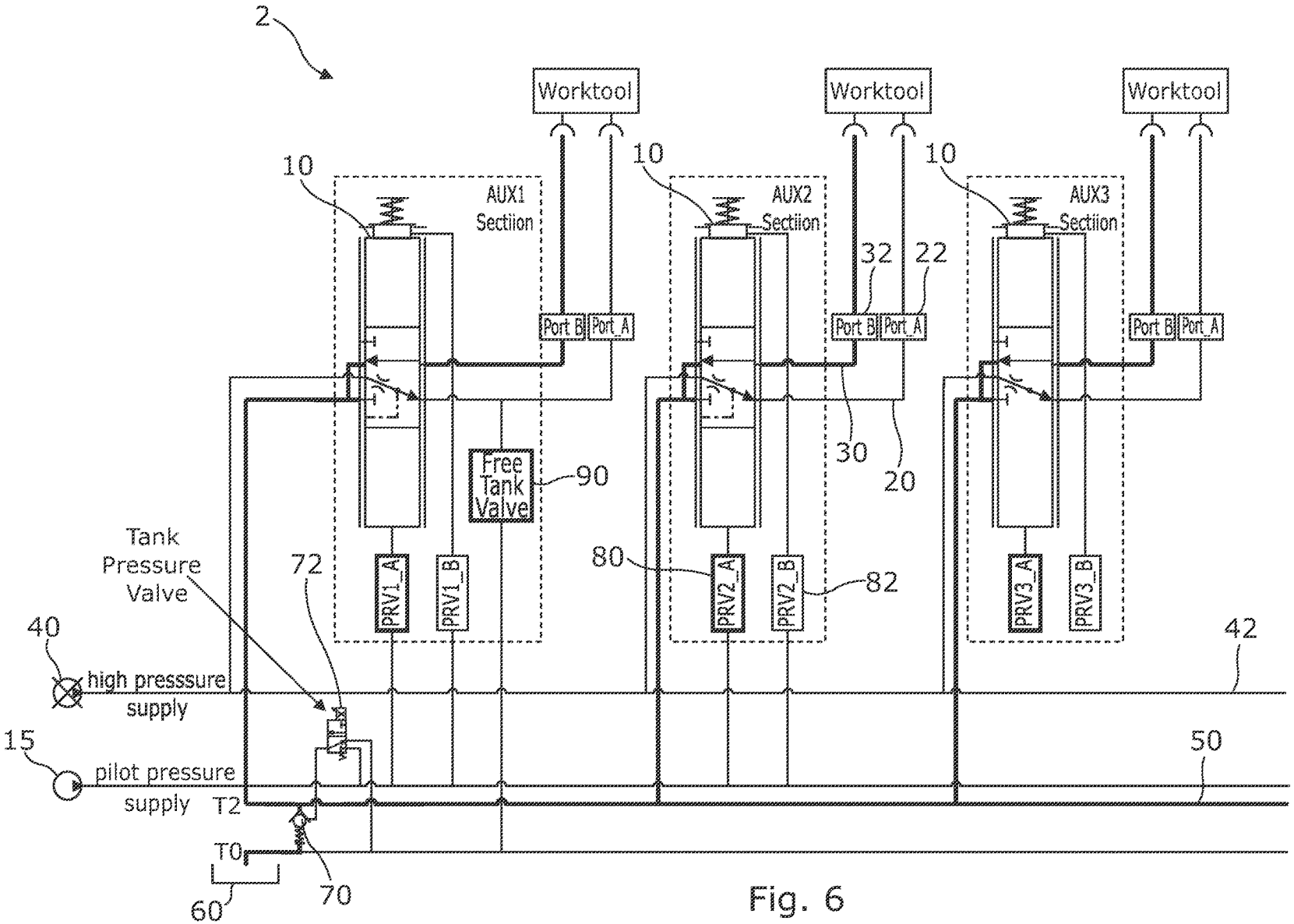
FIG. 6 shows a schematic diagram of a hydraulic system of FIG. 4 where each of the spool valves are in the second position.

FIG. 6 shows a schematic diagram of the hydraulic lines being reduced in pressure when the spool valves 10 are in the second position. In the diagram of FIG. 6, the tank valve 90 s closed when the spool valve is in the second position.

Thus, the controller may control the spool valves 10 of the further embodiment to reduce pressure in a plurality of worktool lines connected to one or more worktools 100 to assist in the disconnection of the worktool(s) 100.

INDUSTRIAL APPLICABILITY

The controller of the embodiments of this disclosure may be configured to provide a worktool disconnect routine for a hydraulic system 1, 2 of a work machine. The worktool disconnect routine may be provided to reduce pressure in hydraulic lines connecting the hydraulic system to the worktool 100 to assist in a processing of detaching the worktool 100 from the work machine.

The controller or hydraulic system of this disclosure may be provided on a work machine such as a tractor, an excavator, a wheel loader or a compactor.

The invention claimed is:

1. A controller for hydraulic system of a work machine, the controller configured to perform a worktool disconnect routine to reduce pressure in a first worktool line and a second worktool line of the hydraulic system, wherein the hydraulic system comprises:

a spool valve including a high pressure inlet and a low pressure outlet;

a first worktool port connected to the spool valve by the first worktool line;

a second worktool port connected to the spool valve by the second worktool line;

the first and second worktool ports configured to be connected to a worktool having a worktool actuator;

a high pressure flow source of hydraulic fluid connected to the high pressure inlet of the spool valve by a high pressure line;

a low pressure tank line connected to the low pressure outlet of the spool valve, the low pressure tank line at a lower pressure than a pressure of the high pressure line;

wherein when performing the worktool disconnect routine the controller is configured to:

check that a power source of the work machine is operating;

instruct the high pressure flow source of hydraulic fluid to provide no flow of hydraulic fluid in the high pressure line to the high pressure inlet of the spool valve during operation of the work machine;

instruct the spool valve to move to a first position wherein the first worktool port is connected to the low pressure tank line via the first worktool line fluidly connecting with the low pressure outlet and the second worktool port is connected to the high pressure flow source via the second worktool line fluidly connecting with the high pressure inlet in order to reduce a pressure in the first worktool line during operation of the work machine and limit flow of hydraulic fluid across the worktool actuator to inhibit movement of the worktool actuator during the worktool disconnect routine; and instruct the spool valve to move to a second position wherein the second worktool port is connected to the low pressure tank line via the second worktool line fluidly connecting with the low pressure outlet and the first worktool port is connected to the high pressure flow source via the first worktool line fluidly connecting with the high pressure inlet in order to reduce a pressure in the second worktool line during operation of the work machine and limit flow of hydraulic fluid across the worktool actuator to inhibit movement of the worktool actuator during the worktool disconnect routine.

2. The controller according to claim 1, wherein the controller is configured to instruct the spool valve to move to the first position for a time period of no greater than 500 ms; and/or the controller is configured to instruct the spool valve to move to the second position for a time period of no greater than 500 ms.

3. The controller according to claim 1, wherein the hydraulic system comprises a hydraulic reservoir connected to the low pressure tank line, wherein the hydraulic reservoir comprises hydraulic fluid at substantially atmospheric pressure.

4. The controller according to claim 3, wherein the low pressure tank line is connected to the hydraulic reservoir by a reservoir pressure valve, wherein the controller is configured to operate the reservoir pressure valve to connect the low pressure tank line to the hydraulic reservoir when the spool valve is in the first position or the second position.

5. The controller according to claim 1, wherein the hydraulic system comprises a plurality of spool valves, each spool valve connected to the high pressure flow source, the low pressure tank line and a pair of worktool ports, wherein the controller is configured to perform the worktool disconnect routine for each of the spool valves.

6. The controller according to claim 1, wherein the controller is configured to initiate the worktool disconnect routine upon at least one of: a button press, an instruction from a computer based interface, a signal from a switch integrated into a coupling mechanism for the worktool.

7. The controller according to claim 1, wherein the controller is configured to perform the worktool disconnect routine as part of a process for connecting a worktool to the work machine.

8. A hydraulic system for a work machine having a power source, the hydraulic system comprising:

a spool valve including a high pressure inlet and a low pressure outlet;

a first worktool line and a second worktool line;

a first worktool port connected to the spool valve by the first worktool line;

a second worktool port connected to the spool valve by the second worktool line;

the first and second worktool ports configured to be connected to a worktool having a worktool actuator;

a high pressure flow source of hydraulic fluid connected to the high pressure inlet of the spool valve by a high pressure line;

a low pressure tank line connected to the low pressure outlet of the spool valve, the low pressure tank line at a lower pressure than a pressure of the high pressure line;

a controller configured to perform a worktool disconnect routine to reduce pressure in the first worktool line and the second worktool line of the hydraulic system, wherein the controller is configured to:

check that the power source of the work machine is operating;

instruct the high pressure flow source of hydraulic fluid to provide no flow of hydraulic fluid in the high pressure line to the high pressure inlet of the spool valve during operation of the work machine;

instruct the spool valve to move to a first position wherein the first worktool port is connected to the low pressure tank line via the first worktool line fluidly connecting with the low pressure outlet and the second worktool port is connected to the high pressure flow source via the second worktool line fluidly connecting with the high pressure inlet in order to reduce a pressure in the first worktool line during operation of the work machine and limit flow of hydraulic fluid across the worktool actuator to inhibit movement of the worktool actuator during the worktool disconnect routine; and instruct the spool valve to move to a second position wherein the second worktool port is connected to the low pressure tank line via the second worktool line fluidly connecting with the low pressure outlet and the first worktool port is connected to the high pressure flow source via the first worktool line fluidly connecting with the high pressure inlet in order to reduce a pressure in the second worktool line during operation of the work machine and limit flow of hydraulic fluid across the worktool actuator to inhibit movement of the worktool actuator during the worktool disconnect routine.

9. The hydraulic system according to claim 8, wherein the controller is configured to instruct the spool valve to move to the first position for a time period of no greater than 500 ms; and/or the controller is configured to instruct the spool valve to move to the second position for a time period of no greater than 500 ms.

10. The hydraulic system according to claim 8, wherein the hydraulic system comprises a hydraulic reservoir connected to the low pressure tank line, wherein the hydraulic reservoir comprises hydraulic fluid at substantially atmospheric pressure.

11. The hydraulic system according to claim 10, wherein the low pressure tank line is connected to the hydraulic reservoir by a reservoir pressure valve, wherein the controller is configured to operate the reservoir pressure valve to connect the low pressure tank line to the hydraulic reservoir when the spool valve is in the first position or the second position.

12. The hydraulic system according to claim 8, wherein the high pressure flow source of hydraulic fluid comprises a variable displacement pump, wherein the controller is configured to destroke the variable displacement pump to provide no flow of hydraulic fluid.

13. The hydraulic system according to claim 8, wherein the hydraulic system further comprises a tank valve connected between the first worktool line and the low pressure tank line, wherein the controller is configured to operate the tank valve to connect the first worktool line to the low pressure tank line when the spool valve is in the first position.

14. The hydraulic system according to claim 13 wherein the tank valve is connected between the first worktool line and a hydraulic reservoir such that the first worktool line is connected to the hydraulic reservoir when the tank valve is operated.

15. The hydraulic system according to claim 8 wherein the hydraulic system comprises a plurality of spool valves, each spool valve connected to the high pressure flow source, the low pressure tank line and a pair of worktool ports, wherein the controller is configured to perform the worktool disconnect routine for each of the spool valves.

16. The hydraulic system according to claim 8, wherein the low pressure tank line is at a pressure of at least 1 bar and no greater than 10 bar.

17. The hydraulic system according to claim 8, wherein the controller is configured to initiate the worktool disconnect routine upon at least one of: a button press, an instruction from a computer based interface, and a signal from a switch integrated into a coupling mechanism for the worktool.

18. The hydraulic system according to claim 8, wherein the controller is configured to perform the worktool disconnect routine as part of a process for connecting a worktool to the work machine.

19. A work machine comprising a hydraulic system according to claim 8 wherein the work machine is one of a tractor, an excavator, a wheel loader or a compactor.

* * * * *